United States Patent [19]

Beenhakker et al.

[11] Patent Number: 4,625,792

[45] Date of Patent: Dec. 2, 1986

[54] RECUPERATIVE HEAT EXCHANGER

[75] Inventors: Henk Beenhakker, Haarlem; Dirk Van Der Giessen, Noord-Scharwoude; Kees Verweij, Limmen, all of Netherlands

[73] Assignee: Hoogovens Groep B.V., Ijmuiden, Netherlands

[21] Appl. No.: 691,586

[22] Filed: Jan. 15, 1985

[30] Foreign Application Priority Data

Jan. 17, 1984 [NL] Netherlands ..... 8400139

[51] Int. Cl.[4] ..... F28F 7/00; F28F 9/02

[52] U.S. Cl. ..... 165/139; 165/158; 165/159

[58] Field of Search ..... 165/159, 70, 133, 139, 165/140, 145, 164, 165, 157, 158

[56] References Cited

U.S. PATENT DOCUMENTS

| | | | |
|---|---|---|---|
| 766,523 | 8/1904 | Reid | 165/139 |
| 2,565,513 | 8/1951 | Morrison | 165/145 X |
| 2,986,454 | 5/1961 | Jewett | 165/140 |
| 3,001,766 | 9/1961 | Laist | 165/140 X |
| 3,268,989 | 8/1966 | Erwin et al. | 165/133 X |
| 3,309,072 | 3/1967 | Cummings | 165/76 X |
| 3,662,817 | 5/1972 | Kendrick et al. | 165/145 X |
| 4,134,451 | 1/1979 | Conant et al. | 165/133 |
| 4,298,057 | 11/1981 | Kihlberg et al. | 165/159 |
| 4,415,020 | 11/1983 | Daugirda | 165/133 X |

FOREIGN PATENT DOCUMENTS

| | | | |
|---|---|---|---|
| 0021111 | 1/1981 | European Pat. Off. . | |
| 500163 | 7/1929 | Fed. Rep. of Germany | 165/139 |
| 1143956 | 2/1963 | Fed. Rep. of Germany . | |
| 3128511 | 2/1983 | Fed. Rep. of Germany . | |
| 1264200 | 5/1961 | France . | |
| 1487039 | 5/1967 | France . | |

*Primary Examiner*—Albert W. Davis, Jr.
*Assistant Examiner*—Randolph A. Smith
*Attorney, Agent, or Firm*—Stevens, Davis, Miller & Mosher

[57] ABSTRACT

A recuperative heat exchanger for gas-gas heat exchange at a temperature above 700° C., comprising a refractory lined vessel having a vertically extending steel shell closed at top and bottom by respective ends, wherein the space within the vessel is divided into respective top and bottom end chambers and a heat-exchange chamber therebetween by top and bottom apertured refractory plates and the end chambers are connected by a plurality of substantially vertical tubes of refractory ceramic material extending between said plates. To provide good contact of the second heat exchange medium with the tubes, connections for respectively supply and discharge of a first one of the heat-exchange media are provided in said ends, and on one side of said steel shell there are a plurality of connections for supply of the second of the heat-exchange media distributed over a region extending both vertically and circumferentially and on the other side of the steel shell there are a plurality of connections for discharge of the second medium also distributed over a region extending both vertically and circumferentially. The connections for supply and discharge of the second medium being connected via respective manifolds to main supply and discharge conduits respectively.

7 Claims, 6 Drawing Figures

RECUPERATIVE HEAT EXCHANGER

BACKGROUND OF THE INVENTION

1. Field of the Invention

The invention relates to a recuperative heat exchanger for gas-gas heat exchange at temperatures above about 700° C. In this specification, heat exchange between a gas and a vapour is included within the scope of the term gas-gas heat exchange as well as heat exchange between a gas and a gas. The invention particularly relates to a heat exchanger comprising a refractory lined vessel having a vertically extending steel shell closed at its top and bottom ends by respective ends, wherein the space within the vessel is divided into respective top and bottom end chambers and a heat-exchange chamber therebetween by top and bottom apertured refractory plates and the end chambers are connected by a plurality of substantially vertical tubes of refractory ceramic material extending between said plates.

2. Description of the Prior Art

Heat exchangers for gas-gas heat exchange at very high temperatures are known from for example blast-furnace technology. There, heat exchangers of the regenerative type are used, in which the heat derived from exhaust gases is stored in ceramic material and combustion air for the blast furnace process is subsequently pre-heated by passing it through this ceramic material. Such exchangers, which are called hot-blast stoves or "cowpers", involve very high investment costs for which reason there have been frequent searches for a gas-gas heat exchanger which is not of the regenerative type but which can be operated as a recuperative heat exchanger at temperatures above 700° C. At temperatures of the order of 700° to 1250° C., metals are not suitable as a construction material for heat exchangers, so that in this temperature range recourse has always been made to regenerative heat exchangers of ceramic material.

GB-A-No. 1100036 describes a heat exchanger as set out in the initial paragraph above. This recuperative heat exchanger has a large number of upright ceramic tubes through which hot combustion gases are passed downwardly so as to heat pressurized air passed upwardly between the tubes. Each tube is in a number of interconnected sections. The tubes are mounted in top and bottom plates within a vessel having domed ends. The upper ends of the tubes are sealed to the top plate but can move through the top plate to allow differential thermal expansion upon heating up and cooling.

SUMMARY OF THE INVENTION

The present invention has the object also of providing a construction for a recuperative heat exchanger which is suitable for gas-gas heat exchange in the temperature range 700° to 1250° C., even when there is a significant pressure difference between the heat exchange gases.

The invention consists in that connections for respectively supply and discharge of a first one of the heat-exchange media are provided in said ends, on one side of said steel shell there are a plurality of connections for supply of the second of the heat-exchange media distributed over a region extending both vertically and circumferentially and on the other side of the steel shell there are a plurality of connections for discharge of the second medium also distributed over a region extending both vertical and circumferentially, the connections for supply and discharge of the second medium being connected via respective manifolds to main supply and discharge conduits respectively.

In horizontal section, the steel shell is preferably of circular shape, but may have another shape, such as square or rectangular. Both ends may be domed but a flat bottom end may be preferable, e.g. as is known in blast furnaces and cowper stoves.

The construction of the heat exchanger of the invention is particularly suitable for the exchange of heat between two gases which are both already at a temperature above 700° C. For example one of the heat exchange media can cool from a temperature of about 1225° to about 930° C., thereby transferring heat to the other heat exchange medium to raise its temperature from about 700° C. to about 1000° C. The heat exchange medium with the highest pressure is preferably in this case passed through the vertical tubes.

However, in many cases an apparatus is required for exchange of heat between two gases in which the lower temperature is much lower, e.g. of the order of 150°–350° C. In that case there is preferred a heat exchanger system consisting of a plurality of heat exchangers connected in series in which the heat exchange at the higher temperature level occurs in a heat exchanger of the present invention as described above, while the other heat exchanger may be of a metal type. Metal heat exchangers for gas-gas heat exchange at temperatures up to 800°–900° C. are available to the expert in the present state of the art. It is therefore not necessary to discuss the construction of such metal heat exchangers in more detail.

Refractory ceramic tubes are commercially obtainable, but usually in restricted lengths. For this reason, but also to permit differential thermal expansion of the tubes, it is recommended that the tubes of the heat exchanger are made in sections and extend through the top plate while being substantially sealed thereto by means permitting relative vertical movement. In modern refractory installations the incorporation of such expansion capability is familiar technology, and the dimensional accuracy of the ceramic elements used and the clearances with which these move relative to each other can be sufficient that an adequately good gas-tight fit is obtained.

This dimensional accuracy can be improved even more when using extra narrow tubes in larger embodiments of the heat exchanger, by incorporating between the end plates one or more lateral partitions or supporting floors with apertures for the tubes. Since the tubes are arranged vertically, they will have little tendency to buckle under their own weight. However, in order to compensate for the effect of the transverse flow of the second heat exchange medium, the partition(s) can support the tubes laterally at one or more heights.

The heat exchanger of the invention can achieve good distribution of the flow of the second heat exchange medium within the steel shell so that there is the most effective possible flow of this second heat exchange medium around the vertical tubes. For this purpose the connections for the supply and discharge of the second heat exchange medium in each case are distributed vertically and circumferentially over the surface of the steel shell. The manifolds preferably each comprise a ring segment connected at a central point on one side to the main supply or discharge conduit and connected on the other side to the said connctions for supply or discharge of the second medium via branches located at points spaced along the length of the segment. This construction has a certain similarity with the ring conduits for the hot blast in blast furnace structures, although the application is wholly different here.

Depending on the structural form of the heat exchanger and the position of the connections, the diameter and the distribution of the diameters thereof in the manifolds can be chosen suitably in order to obtain an optimal heat transfer to the tubes.

The refractory lining of the steel shell and the bottom end do not pose any special technical problem, since this requires technology similar to that of cowpers. Such a problem may however arise with the refractory lining of the top end. A suitable construction for this is that the upper end is outwardly domed and has its periphery radially outwardly of the said steel shell, the upper end having a refractory lining which is a self-supporting dome supported at its base radially outwardly of the innermost lining layer of the steel shell. A self-supporting dome of this kind is known in itself. This construction has the effect that any thermal expansion in the innermost layer of lining of the steel shell does not affect the support of the domed construction within the top end.

The stability of the top and bottom plates between which the vertical tubes extend is important. These plates should not be affected in the relevant temperature range by their own weight or that of the tubes. It is conceivable that these plates should be made slightly convex for this purpose, but greater safety can be obtained if, as is preferred according to the invention, the top and bottom plates comprise metal boxes lined exteriorly at both upper and lower sides by refractory material, with the interiors of the boxes forming passages for the flow of coolant. If the heat eschanger forms part of a system with two or more series-connected heat exchangers, in which a relatively cold gas is introduced at the coolest end of the series, this cold gas can be used as a coolant for the top and bottom plates.

INTRODUCTION OF THE DRAWINGS

A preferred embodiment of the invention will be described below by way of non-limitative example with reference to the accompanying drawings, in which:

FIG. 1 shows schematically a heat exchanger embodying the invention in side view, FIG. 2 is a top view of the heat exchanger of FIG. 1, FIG. 3 is a schematic circuit for a series of heat exchangers including one embodying the invention FIG. 4 shows schematically the heat exchanger of FIG. 1 in longitudinal section, FIG. 5 shows a detail in section of a vertical tube from the heat exchanger of FIG. 1, and FIG. 6 shows a detail of a cooled top plate of the heat exchanger of FIG. 1 in longitudinal section.

DESCRIPTION OF THE PREFERRED EMBODIMENT

Figure 1:
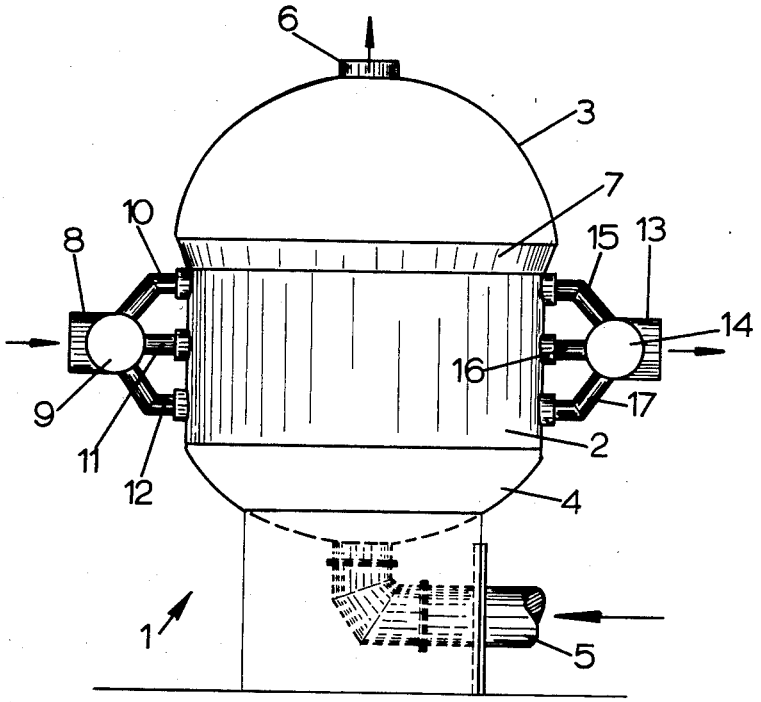
Figure 2:
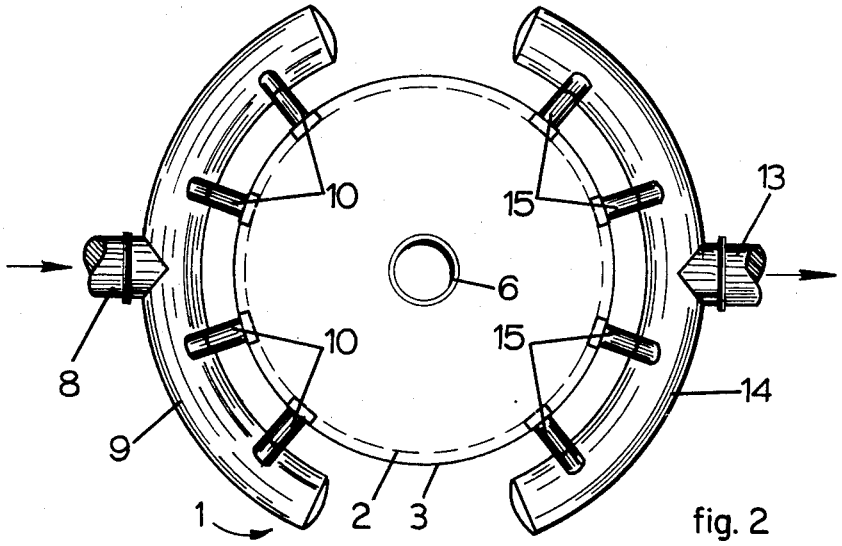

Shown in FIGS. 1 and 2 is a heat exchanger 1 for gas-gas heat exchange embodying the present invention, in which a cylindrical steel shell or jacket 2 with vertical axis is closed at its top and bottom ends by outwardly domed steel ends 3 and 4. A first heat exchange medium is introduced from a supply line 5 through a connection in the bottom end 4, and this medium leaves the top end 3 via a discharge connection 6. The top end 3 has a shape which extends to its periphery which is located radially further outwardly than the circumference of the cylindrical shell 2. A tapering transitional piece 7 serves to connected it to the cylindrical shell 2.

The second heat exchange medium is introduced via a supply conduit 8 into a ring segment 9 which it joins at one side at a central point. Spaced along the segment 9 on the other side (inside) are a plurality of branches 10,11 and 12. By means of connections, these admit the medium into the cylindrical vessel 2, so that the second heat exchange medium is introduced in the case illustrated at several levels through a total of twelve inlet openings, which are thus distributed of a vertically and circumferentially extending region of the shell 2.

In a similar and symmetrical way the second heat exchange medium is discharged from the vessel via connections into vertically and horizontally spaced branches 15,16,17 and thence into a ring conduit segment 14 and a discharge conduit 13.

Figure 4:
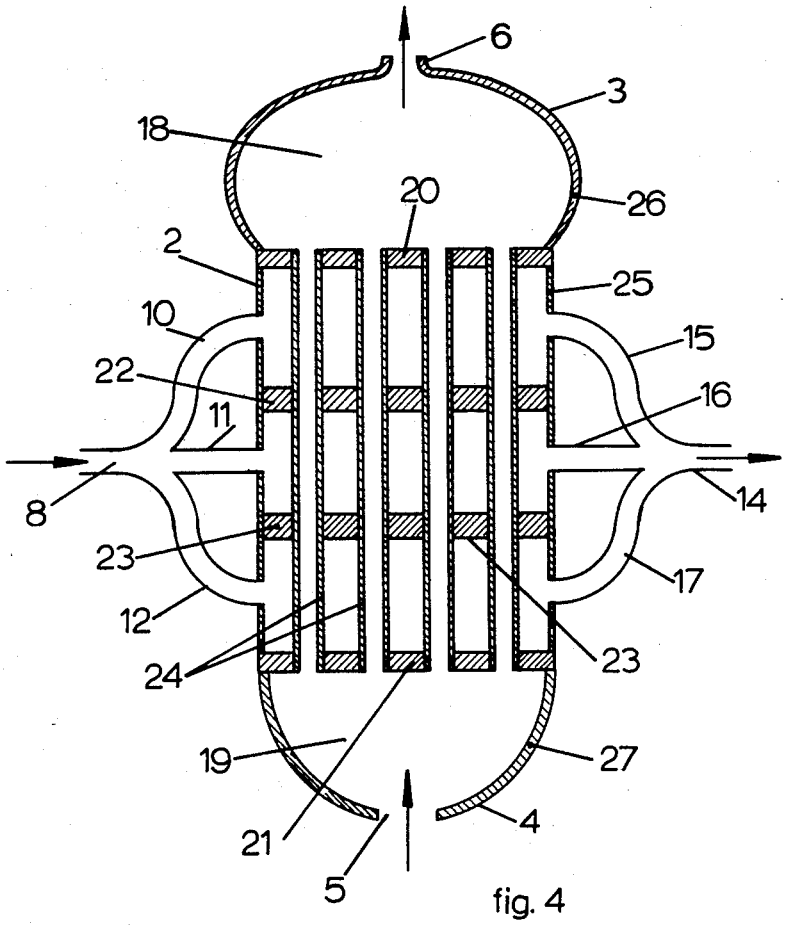

Referring to FIG. 4, inside the top and bottom ends 3 and 4 there are open chambers 18 and 19 which are separated by a top plate 20 and a bottom plate 21 from the chamber within the cylindrical shell 2. The chambers 18 and 19 are connected together by a set of tubes 24 of which for clarity only four are shown in this Figure. The tubes 24 are supported on the bottom plate 21 in the apertures thereof and are fixed to it, while they project through the apertures of the top plate with some allowance for differential expansion. In order to prevent deflection of the tubes 24 under the influence of the transverse flow of the second heat exchange medium, horizontal supporting partitions or floors 22 and 23 are provided intermediately between the top and bottom plates, the floors 22,23 having apertures in which the tubes 24 can move.

The steel shell 2, top end 3 and bottom end 4 are entirely lined with layers of insulating refractory material 25,26 and 27. In a corresponding way the conduits 5,6 and 8 to 17 are lined with a refractory material (not shown) in a manner which is known.

Figure 5:
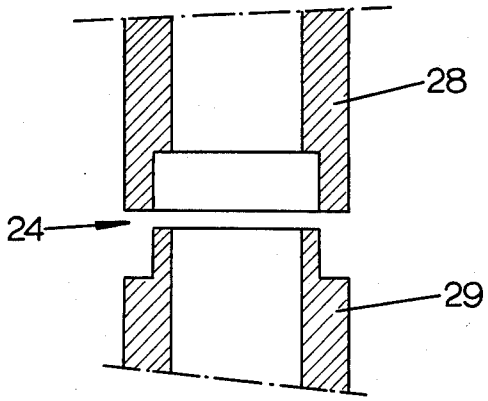

The ceramic tubes 24 are, in the case illustrated, made from a high quality refractory material, e.g. silicon carbide. Tubes of this material are available in various lengths. In the case of large installations it may in some circumstances be recommendable that instead of manufacturing longer tubes, the tubes 24 should be assembled from sections which can move relatively when there is some expansion, but this should be arranged without affecting the gas-tightness. FIG. 5 shows, in this connection, on a larger scale how two sections 28,29 of a tube 24 can fit into each other while maintaining gas-tightness.

Figure 6:
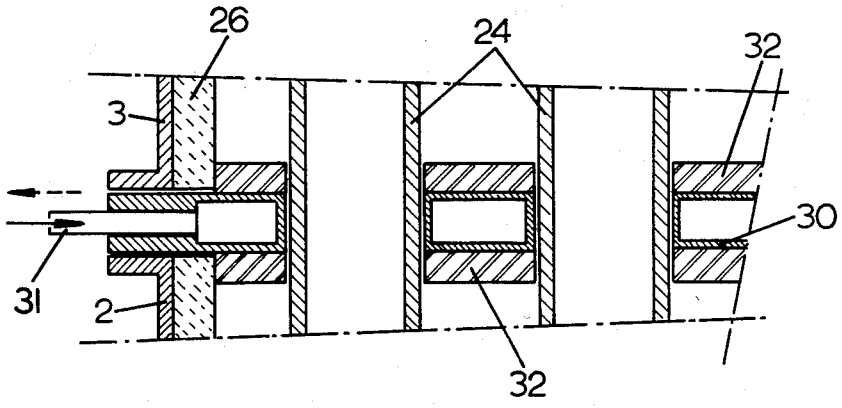

FIG. 6 shows in section on a larger scale a part of the construction of the top plate 20. Principally this plate consists of a box-shaped body 30 whose interior space is connected to supply and discharge conduits 31 for a coolant. The box-shaped body 30 is exteriorly clad on top and bottom with layers of refractory material 32. By means of this construction there is obtained a cooled rigid construction for the top and bottom plates, in which nevertheless the layers of insulating refractory lining 32 ensure that the coolant does not have an unnecessarily unfavourable effect on the efficiency of the heat exchanger.

Figure 3:
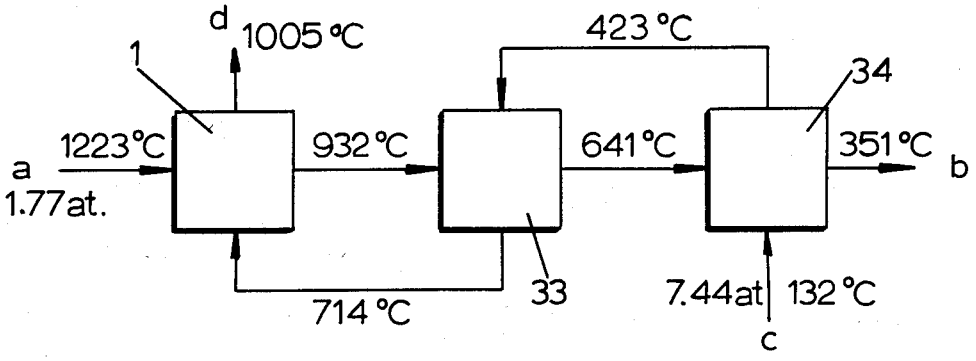

If the ceramic heat exchanger 1 according to FIGS. 1,2,4,5 and 6 forms part of an installation in which gases have to be cooled to temperatures significantly below 700° C., or gases colder than 700° C. have to be heated, FIG. 3 shows a possible series circuit of the heat exchanger 1 together with two metal heat exchangers 33 and 34. This series circuit is also an embodiment of the invention, in this aspect. For illustration a number of temperatures and pressures have been indicated on this Figure, for the two heat exchange media. At point A a gas at temperature 1223° C. and pressure 1.77 atm. is introduced to the ceramic heat exchanger 1 and, after moving from left to right successively through the three heat exchangers, is discharged with a temperature of 351° C. at point B. A cold gas with an initial temperature of 132° C. and an overpressure of 7.44 atm. is supplied at point C to heat exchanger 34, and flows zig-zag in counterflow through the three heat exchangers, in order to leave the installation finally at point D with a temperature of 1005° C. The pressures and temperature shown are purely for illustration and have no significance in themselves. This Figure illustrates the possibility of effecting heat exchange between gases within a very wide temperature range, the heat exchange at the highest temperature level being performed in the new heat exchanger of FIG. 1 according to the invention.

What is claimed is:

1. A recuperative heat exchanger for gas-gas heat exchange at a temperature above 700° C., comprising (a) a refractory lined vessel having a vertically extending steel shell having an open top and bottom and respective ends of said vessel closing said top and bottom, (b) top and bottom apertured refractory plates dividing the space within the vessel into respective top and bottom end chambers and a heat-exchange chamber therebetween, (c) a plurality of substantially vertical tubes of refractory ceramic material extending between said plates and connecting the said end chambers, (d) connections for respectively supply and discharge of a first heat-exchange media provided in said ends, (e) on one side of said steel shell a plurality of connections for supply of a second heat-exchange media distributed over a region of said shell, said plurality of connections extending both vertically and circumferentially, (f) and on the other side of the steel shell a plurality of connections for discharge of the second medium also distributed over a region of said shell extending both vertically and circumferentially, and (g) manifolds connecting the said connections for supply and discharge of the second medium to main supply and discharge conduits respectively.

2. A heat exchanger according to claim 1 having at least one transverse partition located between said end plates having apertures through which the tubes pass and laterally supporting the tubes.

3. A heat exchanger according to claim 1 wherein said manifolds each comprise a ring segment connected at a central point on one side to a main supply or discharge conduit and connected on the other side to the said connections for supply or discharge of the second medium via branches located at points spaced along a length of the segment.

4. A heat exchanger according to claim 1 in which the upper end is outwardly domed and at its periphery has a tapered transitional piece which extends at its periphery radially outwardly of the said steel shell, the upper end having a refractory lining which is a self-supporting dome supported at its base radially outwardly of an innermost lining layer of the steel shell.

5. A heat exchanger according to claim 1 wherein said top and bottom plates comprise metal boxes having interiors lined exteriorly at both upper and lower sides by refractory material, with the interiors of the boxes forming passages for the flow of coolant.

6. The heat exchanger of claim 1 to which is connected in series a plurality of heat exchangers in which heat exchange takes place at a temperature below 700° C.

7. The heat exchanger according to claim 6 wherein said plurality of heat exchanger(s) in which heat exchange takes place at a temperature below 700° C. are of metal.

* * * * *